United States Patent [19]

Pelavin

[11] 3,933,229

[45] Jan. 20, 1976

[54] MULTI-FUNCTIONAL FOLDABLE SUITCASE

[75] Inventor: Joseph Y. Pelavin, North Bergen, N.J.

[73] Assignee: Lark Luggage Corporation, New York, N.Y.

[22] Filed: June 5, 1974

[21] Appl. No.: 476,644

[52] U.S. Cl. ..... 190/41 B; 190/41 Z; 190/49; 190/51; 190/52

[51] Int. Cl.[2] ..... A45C 3/00

[58] Field of Search ..... 190/41 R, 41 B, 43, 49, 190/51, 52, 41 C, 41 Z, 42, 48; 206/278, 287, 288, 289

[56] References Cited

UNITED STATES PATENTS

| | | | |
|---|---|---|---|
| 1,859,052 | 5/1932 | Ritter, Jr. | 190/41 B |
| 2,086,895 | 7/1937 | Cart | 190/43 |
| 2,370,492 | 2/1945 | Russell | 190/43 |
| 2,453,663 | 11/1948 | Hinson | 190/41 B X |
| 2,695,085 | 11/1954 | Ritter, Jr. | 190/43 |
| 2,702,105 | 2/1955 | Ritter, Jr. | 190/43 |
| 2,797,779 | 7/1957 | Davis | 190/43 |
| 2,887,196 | 5/1959 | Davis | 190/43 |
| 3,115,959 | 12/1963 | Jaffee | 190/43 |
| 3,139,164 | 6/1964 | Koffler | 190/43 |
| 3,315,772 | 4/1967 | Katz | 190/43 |
| 3,542,170 | 11/1970 | Bialo | 190/43 X |

*Primary Examiner*—William T. Dixson, Jr.
*Assistant Examiner*—Stephen Marcus
*Attorney, Agent, or Firm*—Blum, Moscovitz, Friedman & Kaplan

[57] ABSTRACT

A multi-functional, foldable suitcase is provided which comprises a pair of flexible, elongated side walls, one of said side walls overlying the other in spaced relationship relative thereto, a flexible end wall of substantially constant cross-section having a pair of opposed edges, each opposed edge being connected to a respective side wall for thereby defining a suitcase enclosure for housing garments therein. Means are provided within remote ends of the enclosure for defining the depth dimension of the suitcase and for defining a pair of concomitant, remote, discrete packing compartments within the enclosure for housing folded garments therein. A means underlies one of the side walls and cooperates therewith for defining a garment suspension space within the enclosure. The means overlies the packing compartments and the suspension space, in general, has dimensions of width and length substantially corresponding to the side wall. Another means is provided and secured to the other side wall for defining fold lines therein, remote ends of the suitcase being foldable into confronting relation about the fold lines.

15 Claims, 15 Drawing Figures

98
58
91
92
38
94
39
41
17
46
20
42
50
67
59'
68
61'
18
44
58
48
92
98
59'
67
91
50
12.
19
38
94
93
39
34
90
41
29
12.
97
11.
16
96
95
11.
32
10.
31
18
29
95
16
96
97
26
25
24
23
27
28
10.
33

MULTI-FUNCTIONAL FOLDABLE SUITCASE

BACKGROUND OF THE INVENTION

This invention relates to suitcases. More particularly, the instant invention relates to improved details of construction for a foldable suitcase including discrete packing compartments and provided with means for suspending garments therein.

Conventional foldable suitcases are commonly employed for the exclusive purpose of suspending garments therein such as suits, dresses and like garments which would otherwise crease, wrinkle or the like if folded and packed into conventional luggage. These conventional foldable cases do not usually include provision for packing large quantities of folded items therein. To the extent that they are adapted to carry even small quantities of folded items, the suitcase is usually provided with a zippered pocket formed between the external suitcase fabric and an interior liner. Alternatively, it has been known to separately fabricate an add-on compartment which may be connected to the suitcase to form a composite unit adapted to carry folded as well as suspended garments or like articles.

However, none of these prior constructions provide an integral, relatively inexpensive unit in which garments may be hung and folded, as desired, with due attention given to the nature of the article. Prior units have been provided with a single access means for which to gain access into the interior of the suitcase. The instant suitcase construction makes provision for access into the discrete packing compartments, as well as providing access to the interior of the suitcase for suspending or removing suspended garments therefrom.

SUMMARY OF THE INVENTION

Generally speaking, in accordance with the invention, a multi-functional, foldable suitcase is provided which comprises a pair of flexible, elongated side walls, one of the side walls overlying the other in spaced relationship relative thereto, and a continuous flexible end wall of substantially constant cross-section having a pair of opposed edges, each opposed edge being connected to a respective side wall for thereby defining a suitcase enclosure for housing garments therein. Means are provided within remote ends of the enclosure for defining the depth dimension of the suitcase and for defining a pair of concomitant, remote, discrete packing compartments within the enclosure for housing folded garments therein. A means underlies one of the side walls and cooperates therewith for defining a garment suspension space within the enclosure. The means overlies the packing compartments and, in general, the suspension space has dimensions of width and length substantially corresponding to the side wall. Another means is secured to the other side wall and defines fold lines therein, the remote ends of the suitcase being foldable into confronting relation about the fold lines.

Accordingly, it is an object of this invention to provide a foldable suitcase which includes discrete packing compartments for folded garments and the like and also is adapted to carry garments suspended substantially for the length of the suitcase.

Another object of the invention is to provide individual access means into the discrete packing compartments provided in the suitcase.

A further object of the invention is to provide access means into the suitcase for suspending or removing garments and like items therefrom without disturbing the items which may be in one or the other discrete packing compartments.

Still another object of the invention is to provide a lightweight non-abrasive frame which is substantially impact-resistant and which is fitted and secured within the suitcase enclosure for defining one or the other discrete packing compartments therein.

Still other objects and advantages of the invention will, in part, be obvious and will, in part, be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1, 2, 3, 4:
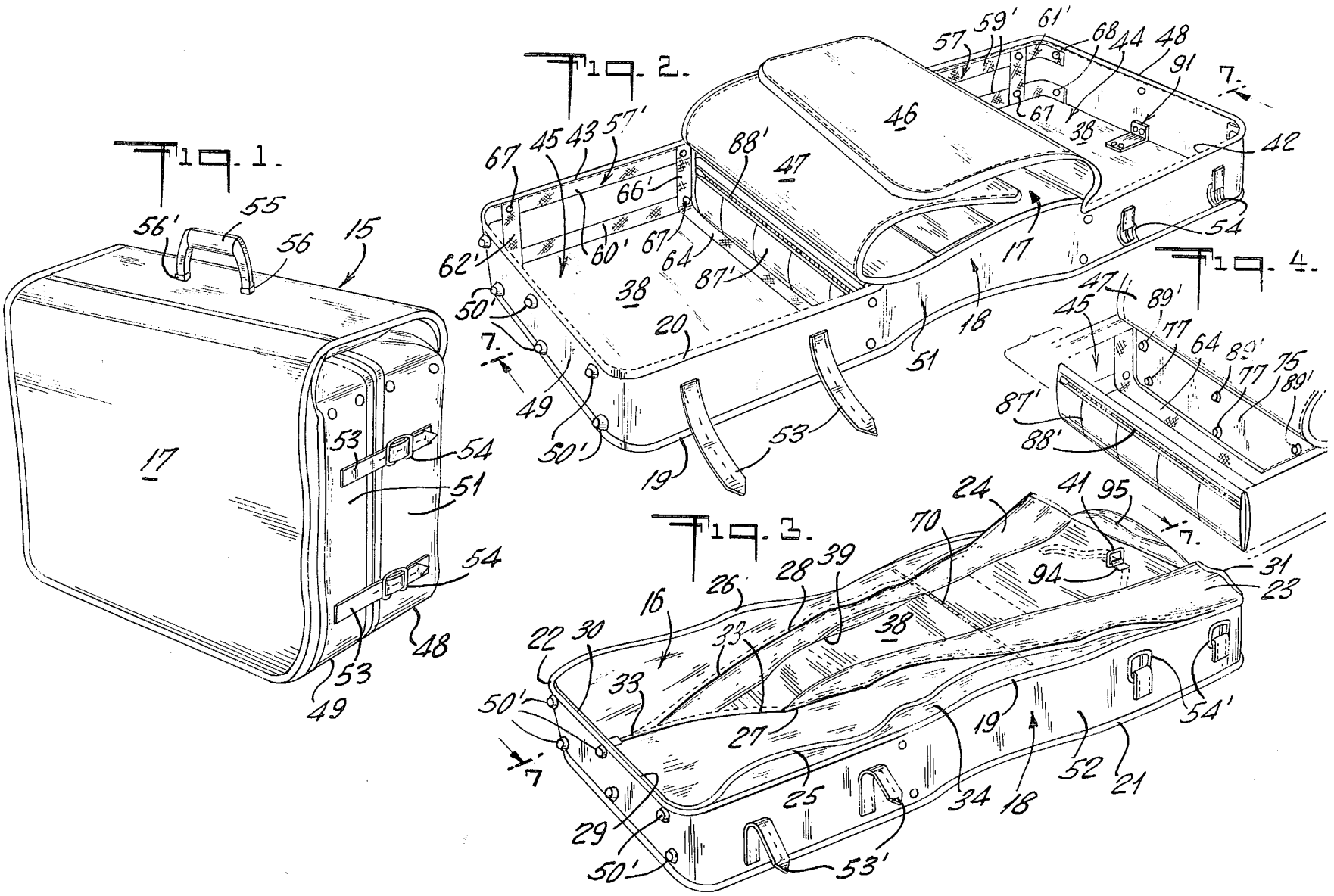
FIG. 1 is a perspective view of a foldable suitcase, shown in a folded condition and constructed in accordance with this invention.
FIG. 2 is a perspective view of the embodiment shown in FIG. 1 in a laid out position showing means for access into the packing compartments provided in the suitcase.
FIG. 3 is a perspective view of the embodiment shown in FIG. 1 in a laid out position showing access to the interior of the suitcase principally for the purpose of suspending or removing suspended garments or like items therefrom.
FIG. 4 is a detail perspective view of a pocket attachment releasably connected to an end wall of the packing compartment shown in FIG. 2.

Referring generally to FIGS. 1–7, the foldable suitcase 15 is of typical or conventional form in that it is rectangular both in cross-section and in longitudinal section. It is, however, unique in its interior construction and means for access thereto. As best seen in FIGS. 2 and 3, the suitcase 15 comprises horizontally disposed side walls which are designated in their entireties respectively by numerals 16 and 17 and an end wall designated in its entirety by numeral 18. The length and width of the suitcase is established by overlying side walls 16 and 17 and the height of the suitcase is established by end wall 18. For the manufacture of the suitcase, side walls 16 and 17 and end wall 18 may be of any suitable flexible material such as, for instance, leather, fabric, or any other suitable material of predetermined length and width.

Figures 7, 8, 9, 10, 13, 14, 15:
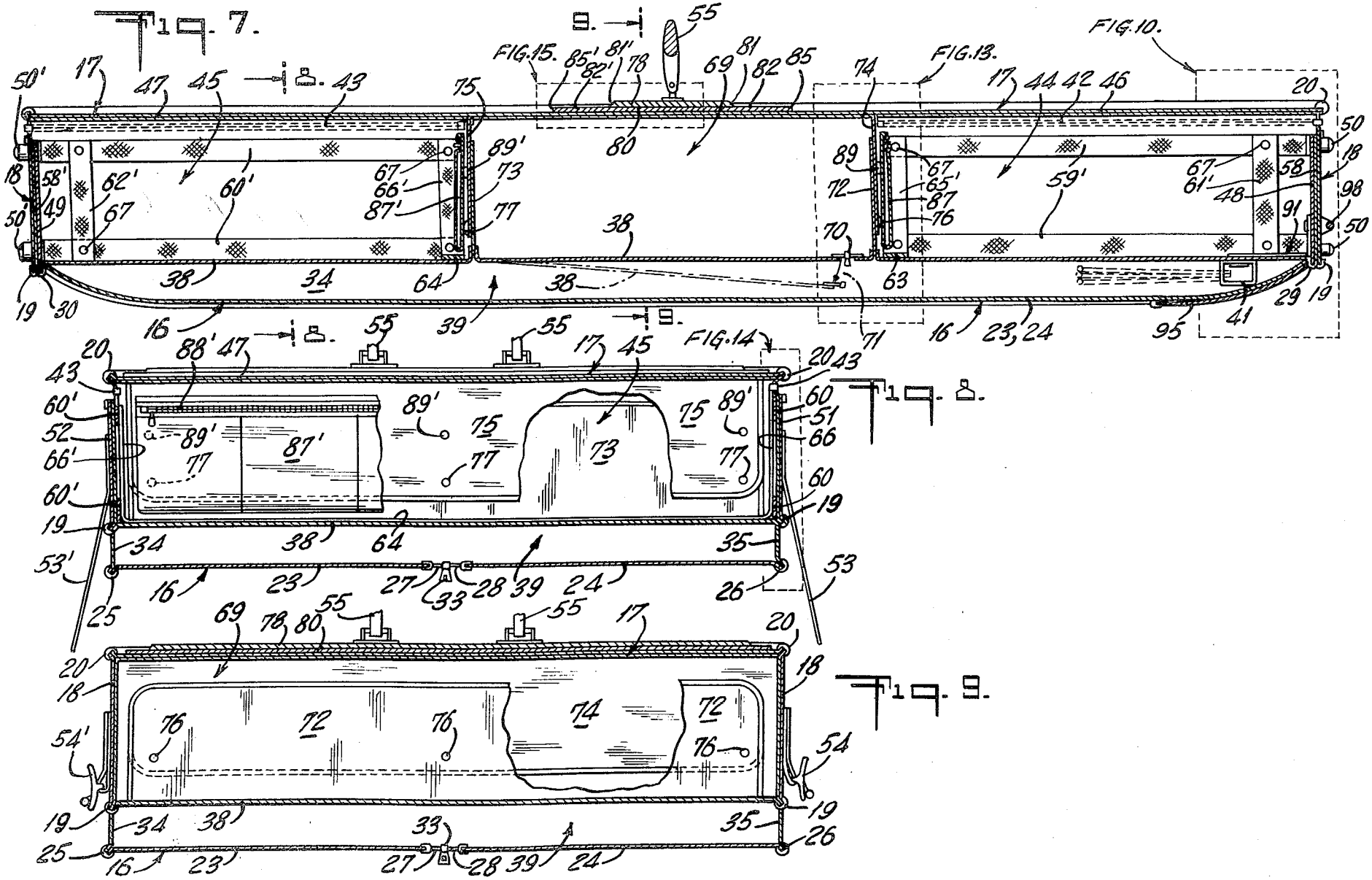
FIG. 7 is a sectional view of the embodiment shown in FIGS. 2 and 3, taken along line 7—7 thereof.
FIG. 8 is a sectional view of the embodiment shown in FIG. 7 taken along line 8—8 thereof.
FIG. 9 is a sectional view of the embodiment shown in FIG. 7, taken along line 9—9 thereof.
FIG. 10 is an exploded view of the detail shown in phantom line in FIG. 7 generally designated by reference to FIG. 10.
FIG. 13 is an exploded view of the detail shown in phantom line in FIG. 7 generally designated by reference to FIG. 13.
FIG. 14 is an exploded view of the detail shown in phantom line in FIG. 8 generally designated by reference to FIG. 14 therein.
FIG. 15 is an exploded view of the detail shown in phantom line in FIG. 7 generally indicated by reference to FIG. 15 therein.

End wall 18 is of substantially constant cross-section and is provided with a pair of substantially parallel opposed edges 19 and 20 which are respectively connected to respective side walls 16 and 17. The connections may be integral or by any mechanical means, for instance, by stitching or by application of an adhesive composition. A pair of abrasion resistant ribs 21 and 22 provided, for instance, with an interiorly extending continuous channel, protects the connection between panels against separation which may be caused by abrasion or rough handling during transit. The respective joints formed by the connection between end wall 18 and respective side walls 16 and 17 may, for instance, fit within the respective continuous channels provided in ribs 21 and 22 and the ribs may be secured thereto by suitable mechanical means such as a suitable adhesive or stitching, as best seen in FIG. 14.

Figure 5:
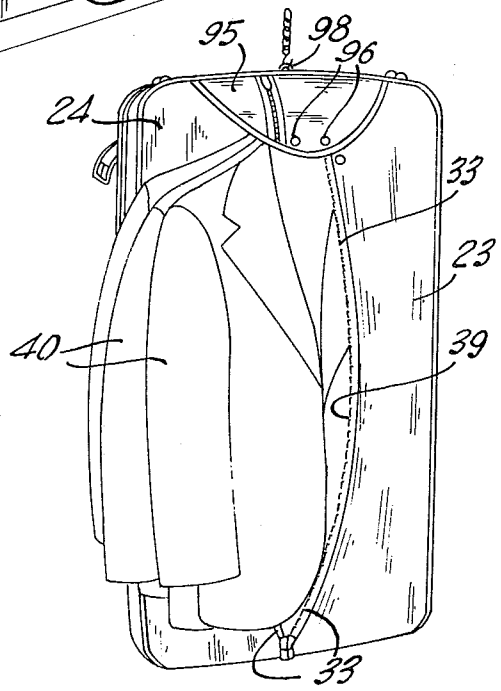
FIG. 5 is a perspective view of the longitudinally suspended suitcase showing the manner in which garments may be suspended therein.
Figure 6:
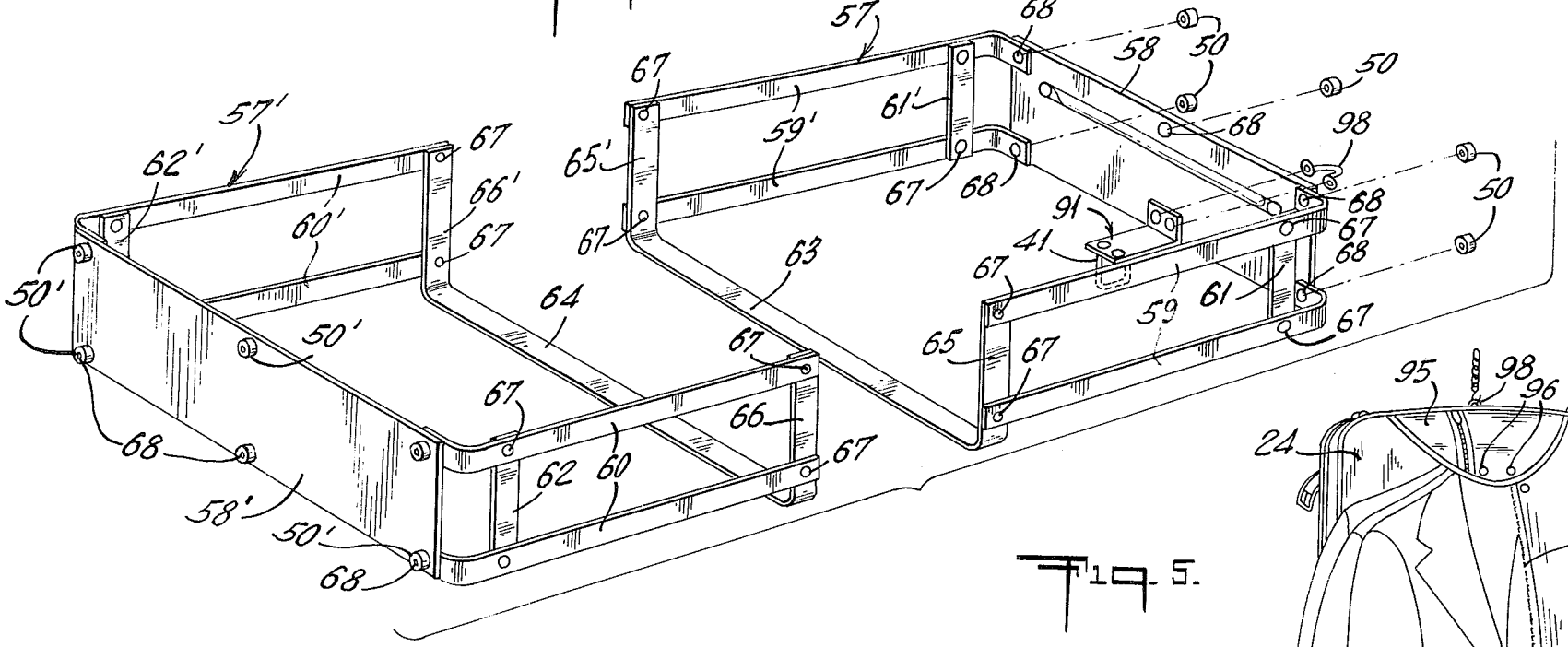
FIG. 6 is a perspective view of an embodiment of the frame which may be fitted and secured within the suitcase to define the packing compartments provided therein.

As best seen in FIGS. 3 and 5, side wall 16 comprises panels 23 and 24 connected along respective longitudinal edges thereof 25, 26 and respective transverse edges thereof 29, 30 to edge 19 of end wall 18. Along their other respective longitudinal edges 27 and 28, panels 23 and 24 are connectable as by zipper 33 for defining side wall 16. Each panel 23 and 24 is provided with a remote transverse edge 31 and 32 which is detached from end wall 18. When the panels 23 and 24 are aligned over suitcase 15, detached transverse edges 31 and 32 are in substantially linear alignment. When the zipper located in flap 16 is moved to an open position, as by moving it from right to left as viewed in FIG. 3 for displaying panels 23 and 24 of side wall 16, each of flaps 23 and 24 is outwardly foldable for gaining access within the suitcase enclosure. To close side wall 16, flaps 23 and 24 are realigned over the enclosure and secured together by zipper 33 as by moving the zipper from left to right, as viewed in FIG. 3.

Flaps 23 and 24 include respective gussets 34 and 35 (not shown) to strengthen the connection thereof to end wall 18 and provide outward extensibility therein for suspending a number of garments under side wall 16. The connection between gussets 34 and 35 and the foldable portion of flaps 23 and 24 may be protected, as by ribs 36 and 37 (not shown), in the manner described above, which descend into and join ribs 21 and 22 at respective ends thereof.

Underlying side wall 16 is a flexible liner 38 seamed into rib 22 and overlying the packing compartments provided in suitcase 15. Between liner 38 and side wall 16 a garment suspension space 39 is defined. A plurality of suits 40, for instance, may be draped over conventional hangers and introduced into garment suspension space 39 overlying liner 38. A catch 41 is provided for the hook portion of the hangers.

As best seen in FIG. 2, additional means for access into the suitcase enclosure is provided. Remote ends of side wall 17 are provided with zippers 42 and 43 for establishing means for entry into packing compartments 44 and 45 defined within the suitcase enclosure. Packing compartments 44 and 45 are themselves discrete and concomitantly therewith zippers 42 and 43 are discrete and the route of each respective zipper adjacent the periphery of side wall 17 is generally configured to conform with the usable packing space provided in compartments 44 and 45. When zippers 42 and 43 are respectively moved in counter-clockwise and clockwise directions along their prescribed paths, a pair of outwardly foldable flaps 45 and 47 are displayed. Each flap 46 and 47 is integrally hinged along a transverse line to side wall 17 and each flap may be discretely outwardly folded as best seen in FIG. 2 to expose the packing area provided in compartments 44 and 45. By realignment of flaps 46 and 47, zippers 42 and 43 may be moved along their paths oppositely to the first mentioned direction thereof for thereby connecting the respective flaps to side wall 17 for closing the suitcase housing.

End wall 18, along remote panels 48 and 49, is provided with exteriorly extending studs 50 (not shown) and 50′. Three pairs of studs 50 and 50′ are provided on each of remote transverse panels 48 and 49 and each pair of studs is adjacent the joint formed where remote transverse panels 48 and 49 respectively join longitudinal panels 51 and 52 of end wall 18. As best seen in FIG. 1, in a folded condition of suitcase 15, it rests upon respective studs 50, 50′ for thereby protecting remote transverse panels 48, 49 thereof against abrasion which may occur during handling and transit.

Referring particularly to FIGS. 1–3, it is observed that straps 53 and 53′ are connected to suitcase 15 at end wall 18. Alignable with each strap 53, 53′ depending from respective longitudinal end wall panels 51, 52 is a buckle 54, 54′ also depending from respective longitudinal end wall panels 51, 52. Each strap 53, 53′ is provided with a plurality of aligned apertures which may be fastened into hook and buckle means 54, 54′. The particular manner in which each strap 53, 53′ engages into each buckle 54, 54′ for securing remote ends of suitcase 15 in a closed condition for transit is best seen with reference to FIG. 1. Respective straps and buckles 53, 54 and 53′, 54′ are aligned for fastening when suitcase 15 is folded. Straps 53, 53′ are each spaced one from the other according to the predetermined size of the packing compartments provided in suitcase 15 and buckles 54, 54′ are respectively oppositely alignable therewith. Moreover, respective straps 53, 53′ and buckles 54, 54′ are spaced a predetermined distance, one from the other, as determined by the general size of suitcase 15 and the provision included therein for folding remote ends thereof into confronting relationship.

For carrying folded suitcase 15, handle 55 is provided. Aligned lugs 56 and 56′ are substantially centrally located in side wall 17 and are secured therein. Each lug 56 and 56′ includes a pair of hingedly connected flanges provided with opposed apertures for receiving a pintle pin received through respective ends of handle 55 for thereby pivotably securing respective ends of handle 55 to lugs 56 and 56'.

Referring now to FIGS. 2, 6, 7 and 10, the configuration and orientation of frames 57, 57' may be observed. In defining packing compartments 44 and 45 within the suitcase enclosure, a pair of frames 57, 57' are employed. Each frame is fitted and secured within the enclosure and at remote ends thereof in substantially mirror image relationship. The frames are provided with a U-configuration and each comprises a rigid base plate 58, 58' having a pair of resilient legs connected thereto. Each leg comprises two pair of substantially parallel struts 59, 59' and 60, 60' joined to opposed ends of respective base plates 58, 58' at respective sets of ends thereof, for instance, by rivets. Spacer strips 61, 61' and 62, 62' are connected at opposite ends thereof to respective struts of each leg, as by rivets, to define a substantially constant distance between struts of respective legs. Another resilient strut 63, 64 extends transversely between substantially parallel legs of the frame. Struts 63, 64 are provided with opposed upstanding vertical legs 65, 65' and 66, 66', each having their free and jointed ends overlying and secured to respective struts 59, 59', 60 and 60'. Upstanding legs 65, 65', 66 and 66' are of substantially the same length as spacers 61, 61', 62 and 62' and the respective lengths of upstanding legs 65, 65', 66 and 66' and spacers 61, 61', 62 and 62' establish the depth of respective packing compartments 44 and 45 within the suitcase enclosure.

Frames 57 and 57' are fitted and secured within respective packing compartments 44 and 45 in the manner shown generally in FIG. 2 and particularly shown in FIGS. 7, 10 and 14 as by rivets 67 which connect upstanding legs 65, 65', 66 and 66' to respective struts 59, 59', 60 and 60' and end wall 18 of the suitcase. The transverse section of each strut 63, 64 as secured and fitted within the suitcase enclosure underlies side wall 16 substantially at the interior end of respective packing compartments 44 and 45. Overlying base plates 58, 58' of frames 57, 57' is a fabric cover so as to prevent any garment packed within compartments 44 and 45 from tearing, snagging or ripping upon a rough or abrasive edge of either plate. Base plates 58, 58' are fixedly connected to end wall 18, for instance, by means of rivets 68. As hereinafter set forth in detail, struts 63 and 64 provide a lever action for folding remote ends of suitcase 15 into confronting relationship.

Referring now to FIGS. 2, 3, 7–9 and 13, located between struts 63 and 64 is a flexible interior housing 69 within the suitcase enclosure. Means for access thereto is provided by a zipper 70 located in liner 38. When side wall 16 is unzippered to display panels 23 and 24 therein and the panels 23 and 24 are outwardly folded, access to the interior of housing 69 may be had by opening zipper 70 for thereby exposing slot 71, shown particularly in FIG. 7. Access into housing 69 may not be had through side wall 17. Housing 69 comprises the mid-portion of liner 38 and a pair of flaps 72 and 73 upstanding therefrom, as best seen in FIG. 7, and a pair of flaps 74, 75 depending downwardly from side wall 17. Respective overlying flaps 72, 74 and 73, 75 are provided with means for making releasable connections therebetween, for instance, snap hooks and fasteners 76 and 77, as best seen in FIG. 13. The height and width of housing 69 is established by respective pairs of releasably connected panels 72, 74 and 73, 75.

As best seen in FIGS. 7 and 15, underlying side wall 17 and secured thereto within housing 69 is a rigid panel 78. The connection between panel 78 and side wall 17 may be mechanical, for instance, supporting feet 79 and 79' (not shown) for respective lugs 56 and 56' may be threaded therethrough into blind openings provided therefor in said lugs. Underlying panel 78 is a resilient panel 80 which extends widthwise a predetermined distance beyond respective edges 81, 81' of rigid panel 78. Each widthwise extension 82, 82' of panel 80 comprises an inwardly flexible portion of predetermined elasticity. Respective margins of each widthwise extension 82, 82' proximate and distal panel 78 are secured to side wall 17, as by transverse stitching 83, 83' and 84, 84' (not shown). Opposed edges 85, 85' of panel 80 define respective fold lines in side wall 17 about which remote ends of suitcase 15 are foldable into confronting relationship, as shown in FIG. 1. To facilitate the fold and minimize the deformation of panel 80 during the folding operation respective hems 86 and 86' (not shown) may be drawn from side wall 17 and tucked and secured under respective edges 85 and 85' of panel 80.

Therefore, housing 69 is provided with a generally rectangular shape and has flexible side walls hingedly connected to liner 38 and side panel 17 and a flexible topside panel through which access into the enclosure formed thereby may be had. Also mounted in panel 78 and lugs 56, 56' into which handle 55 is journalled. Articles enclosed within housing 69 are generally segregated from the hung or folded garments which may be included within the suitcase. For instance, it may be desirable to enclose within housing 69, items such as soiled garments, toiletries and like items which otherwise may ruin folded or suspended garments by spillage.

Referring particularly to FIGS. 2, 4, 8, 9 and 13, pocket members 87 and 87' may be provided for housing desirably segregable small items therein. Each pocket is substantially tubular and respective ends thereof are provided with zippers 88, 88' for access into the pockets. Pockets 87, 87' are releasably connected to side walls of housing 69, as by snap fasteners 89, 89' which are located respectively on the rear panel of the pocket and exterior surface of the respective side wall.

Figures 10, 11, 12:
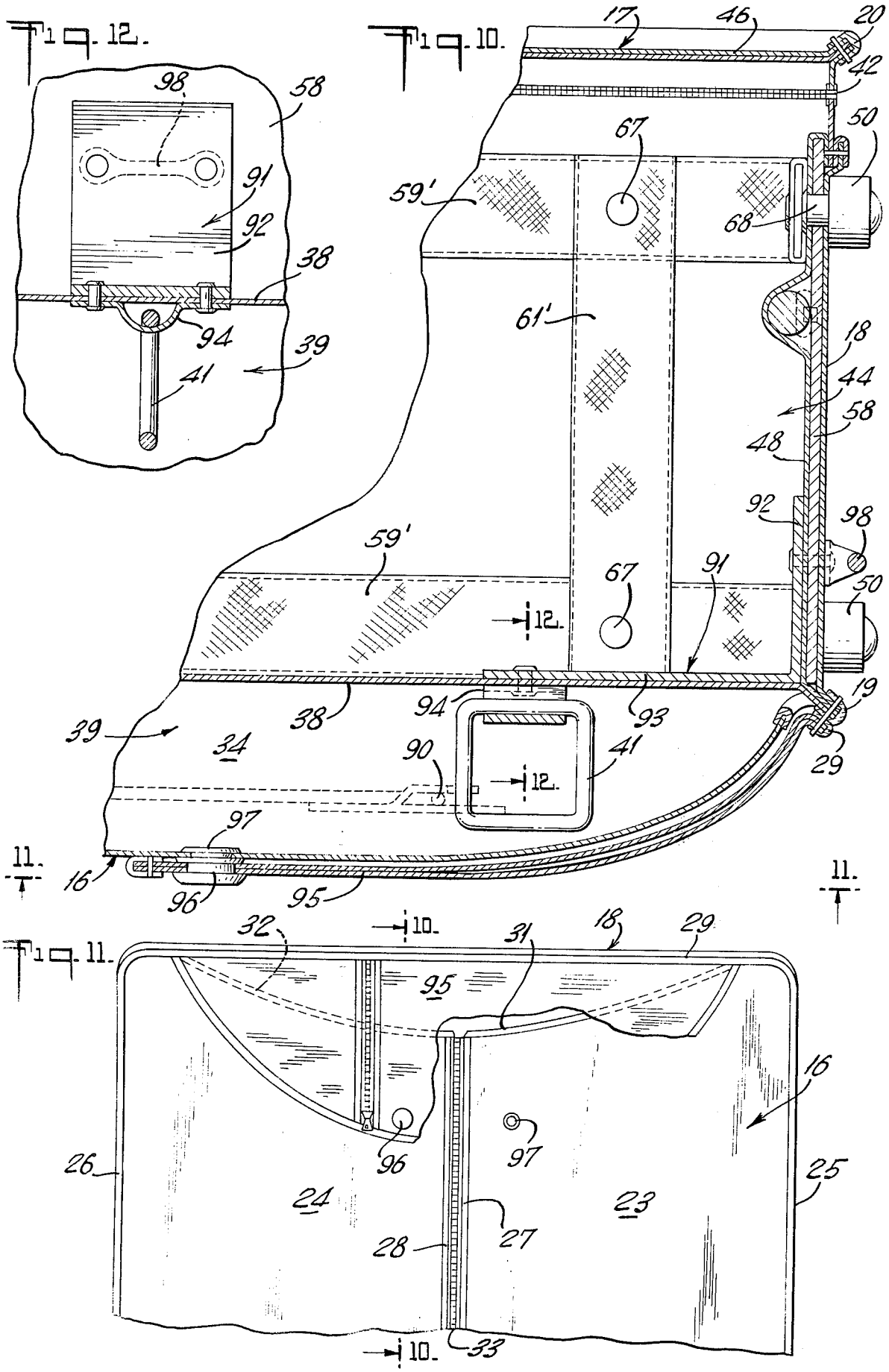
FIG. 11 is a sectional view of the embodiment shown in FIG. 10, taken along line 11—11 thereof.
FIG. 12 is a sectional view of the embodiment shown in FIG. 10, taken along line 12—12 thereof.
Figure 13:
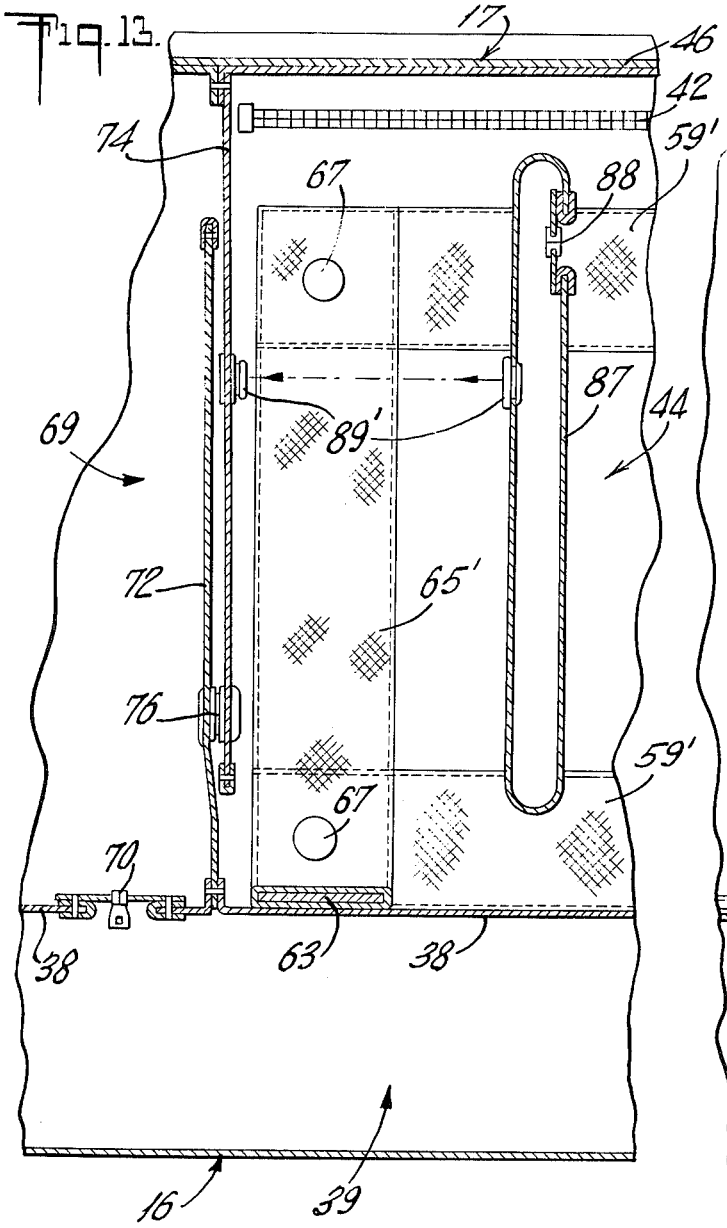
Figure 14:
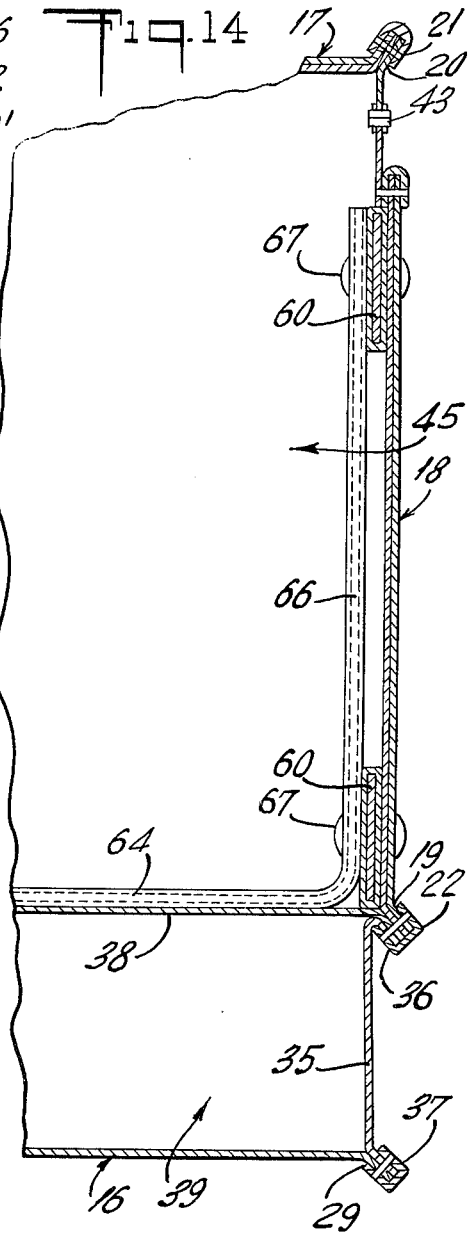
Figure 15:
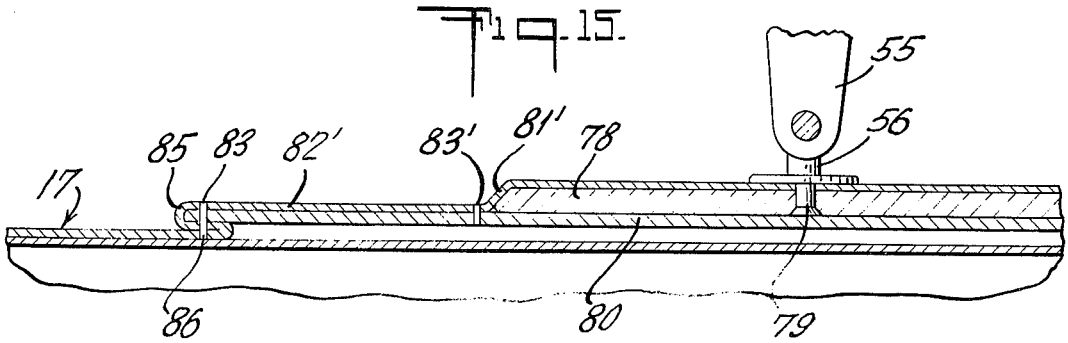

As best seen in FIGS. 3, 7 and 10, liner 38 flexibly underlies side wall panel 16 of the suitcase and is deformable, and garments which are suspended within the suitcase enclosure such as suits, dresses, slacks and like garments may be suspended thereover and these garments underlie extensible side wall 16 of the suitcase which is provided with access means thereto. The natural deformation of liner 38 under the pressure of suspended overlying garments provides a natural pocket therebetween and extensible side wall 16 for thereby maintaining the position of garments suspended within the suitcase enclosure. The garments to be suspended for the length of the suitcase enclosure are generally themselves suspended from conventional hangers provided with a hook member, and a lug 90 is provided for releasably latching the hanger thereto, as best seen in FIGS. 10 and 12. An angle bar 91 is fixedly connected to base plate 58 of frame 57, one section thereof 92 being connected to base plate 58 and the other section 93 thereof overlying liner 38. A collar 94 is fixed to section 93 and depends downwardly therefrom through an access opening in liner 38 into suspension space 39. A closed end lug 41 is carried in collar 94 and provides means for hanging the garments to be suspended.

In packing the suitcase for transit, access thereto may be had, for instance, through side wall 16, in the manner heretofore described and in packing compartments 44 and 45 may be placed folded garments and like items and articles. Into housing 69 desirably segregable items of the type described may be placed through access means 70, 71. Thereafter, garments which it is desired to suspend full length in transit may be connected to flange 41 and extended for the length of the suitcase enclosure as defined between side wall 16 and liner 38. Thereafter, panels 23 and 24 may be secured together in the manner described for enclosing all packed articles within the suitcase enclosure.

As best seen in FIGS. 5 and 11, a flexible flange 95 may be hingedly connected along transverse panel 48 of end wall 18 which is adapted to overlie the zipper starting point provided is side wall 16. Flexible flange 95 is provided with snap hook receivers 96 which coact with button fasteners 97 mounted exteriorly on side wall 16 and when fastened thereto, assure against accidental opening of zipper 33 during transit of the suitcase. When it is not desired to suspend garments within the suitcase for the length thereof, then access may be had into compartments 44 and 45 from side wall 17 of the suitcase. One or the other or both of compartments 44 and 45 may be packed as desired and if only one of the compartments is packed, the packed garments will not shift during transit of the suitcase because each packing compartment is discretely defined between a frame 48 and a sidewall of interior housing 69. To facilitate the hanging of garments, such as suits 40 in access space 39, transverse panel 48 of end wall 18 has a button hook 98 connected thereto and the case 15 may be suspended thereon for access into suspension space 39.

After the suitcase has been packed, it may be placed or turned on a substantially flat surface to display side wall 16. Remote ends of the suitcase are individually grasped with either hand and flexed upwardly thereby folding compartments 44 and 45 into confronting back to back relationship. The back to back remote ends of the suitcase may be secured in the manner described with straps 53, 53' and buckles 54, 54'. As best seen in FIG. 1, the packed and folded suitcase displays side wall 17. In folding the remote ends of the suitcase, each end levers around its transverse member 63, 64 and the fold lines defined by panel 80 which flexes somewhat during the closure.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A multi-functional, foldable suitcase comprising first and second flexible, elongated side walls, said first side wall overlying said second side wall in spaced relationship relative thereto, a continuous flexible end wall of substantially constant cross-section having a pair of opposed edges, each opposed edge being connected to a respective side wall for thereby defining a suitcase enclosure for housing garments therein, said suitcase enclosure having a pair of remote ends therein, means within said remote ends of said enclosure for defining a pair of concomitant, discrete packing compartments within said enclosure for housing folded garments therein, each of said packing compartments having a depth corresponding to said means, said means comprising first and second substantially resilient configured frames of predetermined length fitted and secured within a respective remote end of said enclosure between said first and second side walls, means underlying said first side wall and cooperating therewith for defining a garment suspension space within said enclosure said last-mentioned means overlying said packing compartments, said suspension space having dimensions of width and length substantially corresponding to said first side wall, and means secured to said second side wall for defining fold lines therein, said remote ends of said suitcase being foldable into confronting relation about said fold lines.

2. The foldable suitcase as claimed in claim 1, wherein said first side wall of said suitcase includes a pair of flexible panel members, each panel member being provided with a longitudinal edge connected to said end wall and a longitudinal edge along which said panel members are engageable for defining said first elongated side wall, each panel member having a respectively contiguous transverse edge which is detached from said end wall, said detached edges being alignable, one with the other, when said body panels are longitudinally connected for forming a composite elongated side wall, each of said panel members being outwardly foldable for access into said garment suspension space within said enclosure.

3. The foldable suitcase as claimed in claim 1, wherein said first configure frame is substantially a mirror image of said second configured frame and each has a U-configuration comprising a rigid base plate and a pair of resilient legs connected thereto at respective ends thereof, each leg comprising a pair of substantially parallel struts connected to said base plate at a respective pair of ends, at least one spacer strip connected at opposite ends thereof to respective struts of each leg to define a substantially constant distance between struts of respective legs, and another strut extending transversely between respective legs of said frame, said another strut having a pair of upstanding arms at opposed ends thereof, each arm being connected to respective struts of a leg of said frame, said another strut underlying said first side wall of said suitcase.

4. The foldable suitcase as claimed in claim 1, including a plurality of studs mounted on remote ends of said end wall, said studs extending exteriorly thereof, said suitcase being supported on said studs when said suitcase is in a folded upright position, said studs preventing abrading of said end wall.

5. The foldable suitcase as claimed in claim 1, including two substantially parallel protective ribs, each rib having an interiorly extending continuous channel, the connected edge between each side wall and said end wall fitting into a channel of a respective rib and being secured therein by mechanical means, said ribs protecting the connective joint between side walls and said end wall against abrasion and detachment during handling of said suitcase.

6. The foldable suitcase as claimed in claim 1, including means mounted in said end wall for fixedly connecting remote ends of said suitcase in a folded condition.

7. The foldable suitcase as claimed in claim 1, including a handle mounted on said other side wall and extending exteriorly of said suitcase enclosure for carrying said suitcase in a folded condition.

8. The foldable suitcase as claimed in claim 1, including a non-abrasive fabric overlying each of said first and second configured frames for preventing abrasion to any garments or like articles packed or suspended within said suitcase enclosure.

9. The foldable suitcase as claimed in claim 1, said means for defining fold lines in said second side wall comprising a rigid panel underlying said second side wall and extending transversely across said side wall, said rigid panel having a pair of opposed substantially transversely extending edges, and a resilient panel underlying said rigid panel and extending widthwise a predetermined distance beyond said edges of said rigid panel, said resilient panel having a pair of opposed substantially parallel transversely extending edges, each widthwise extension of said resilient panel comprising an inwardly flexible portion of determined elasticity, respective margins of each flexible portion proximate and distal said rigid panel being secured to said second side wall, said opposed edges of said resilient panel defining respective fold lines in said second side wall about which said remote ends of said suitcase are foldable into confronting relation.

10. The foldable suitcase as claimed in claim 9, said panels underlying said second side wall substantially at a mid-point thereof and being substantially symmetrical about a plane transversely bisecting said suitcase.

11. The foldable suitcase as claimed in claim 1, including a pair of discrete means for access into each discrete packing compartment within said enclosure, said discrete means generally having the configuration of a respective first and second configured frame defining said discrete packing compartments within said enclosure.

12. The foldable suitcase as claimed in claim 11, each discrete means for access into each discrete packing compartment within said enclosure including a gusset connected between said end wall and said second side wall, and a zipper having open and closed positions mounted in said gusset, in an open position of said zipper a portion of said second side wall overlying and corresponding with one of said packing compartments being outwardly foldable for entry into said compartment.

13. The foldable suitcase as claimed in claim 1, said means underlying said first side wall and cooperating therewith for defining said garment suspension space within said enclosure comprising a flexible liner.

14. The foldable suitcase as claimed in claim 13, including a pair of flexible partitions connected between said side wall and said liner within said enclosure and substantially perpendicular thereto, said partitions being substantially parallel and spaced, one from the other, each of said partitions segregating one of said packing compartments from the other, said partitions defining an interior enclosure within said suitcase for segregating selected articles, such as toiletries, soiled garments and like items from said discrete packing compartments and said garment suspension space, and means for access into said interior enclosure provided in said liner.

15. The foldable suitcase as claimed in claim 14, wherein each of said partitions comprises a pair of releasably connected flaps, one of said flaps having a fixed connection at one end thereof to said liner and the other flap having a fixed connection to said side wall, said flaps being disconnectable for access into said interior enclosure.

* * * * *